United States Patent [19]

Tenhundfeld et al.

[11] Patent Number: 4,951,737

[45] Date of Patent: Aug. 28, 1990

[54] MODULAR BLOWER AND HEATER ASSEMBLY FOR AIR CONDITIONER

[75] Inventors: John H. Tenhundfeld; Daniel R. Melchior; Michael A. Duckworth, all of Cedar Rapids, Iowa

[73] Assignee: Amana Refrigeration, Inc., Amana, Iowa

[21] Appl. No.: 265,091

[22] Filed: Oct. 31, 1988

[51] Int. Cl.[5] ..... F28F 7/00; F24H 9/02; F25D 23/12

[52] U.S. Cl. ..... 165/1; 165/58; 165/76; 165/78; 62/262; 62/298; 219/366; 219/370

[58] Field of Search ..... 165/57, 58, 76, 78, 165/63, 64, 48.1, 1; 62/262, 298; 219/369, 370, 366, 367, 368

[56] References Cited

U.S. PATENT DOCUMENTS

| | | | |
|---|---|---|---|
| 2,265,272 | 12/1941 | Ditzler | 62/298 |
| 2,813,406 | 11/1957 | Smith | 165/57 |
| 2,891,389 | 6/1959 | Tull | 62/262 |
| 3,157,776 | 11/1964 | Sohn et al. | 219/369 |
| 3,251,540 | 5/1966 | Kinsworthy | 165/58 |
| 3,263,749 | 8/1966 | Dormitzer | 219/369 |
| 3,305,164 | 2/1967 | Laing | 219/370 |
| 3,665,727 | 5/1972 | Mather | 62/298 |
| 3,741,290 | 6/1973 | Nenadal | 165/48.1 |
| 4,167,210 | 9/1979 | Young | 165/58 |
| 4,449,376 | 5/1984 | Draper et al. | 62/298 |
| 4,637,223 | 1/1987 | Hosoya et al. | 62/263 |
| 4,669,534 | 6/1987 | Maeda et al. | 62/262 |

*Primary Examiner*—John Ford

*Attorney, Agent, or Firm*—William R. Clark; Richard M. Sharkansky

[57] ABSTRACT

A package terminal air conditioner having a modular blower and heater unit that is readily removable intact for servicing. The module includes a housing or box that has a back scroll portion and a pair of ends or side panels. The ends have rearwardly extending tabs and top forwardly extending mounting brackets. A cross-flow blower wheel is spaced adjacent the scroll portion of the housing and is supported by the ends. A shaft extending from the blower wheel is connected to a motor. An electric heating element is mounted to the housing, and the motor and heating element are connected to an electrical connector. The module is installed into an indoor section compartment of the air conditioner, and the tabs insert through slots in the main partition. The mounting brackets are then affixed and the connector is mated to a matching connector.

9 Claims, 3 Drawing Sheets

MODULAR BLOWER AND HEATER ASSEMBLY FOR AIR CONDITIONER

BACKGROUND OF THE INVENTION

The field of the invention generally relates to air conditioners, and more particularly relates to a package terminal air conditioner having a blower and heater module that is removable intact for servicing.

U.S. Pat. No. 4,637,223 describes a package terminal air conditioner that has been sold commercially. The unit includes a partition that divides the interior of the housing into an indoor section and an outdoor section. Conventionally, the outdoor section includes a condenser, compressor, and propeller fan that directs air through the condenser. The indoor section has a laterally aligned cross-flow fan that provides very quiet operation. The evaporator or indoor coil is positioned in front of the cross-flow blower wheel, and in operation, air is drawn by the wheel in through the evaporator where it is cooled before being expelled back into the room. When operating in a heating mode, an electric heating element positioned below the blower wheel is activated instead of the evaporator.

In the above-described unit, the partition also serves as the scroll portion of the cross-flow fan, in addition to dividing the unit into indoor and outdoor sections. With such arrangement, the cross-flow blower wheel is initially assembled to the partition so as to retain the proper clearance between the blower wheel and the scroll. Accordingly, maximum air flow is provided while still maintaining enough clearance to minimize noise.

The above-described air conditioning unit also has a significant drawback in that it is difficult to disassemble for servicing such parts as the cross-flow blower wheel, the motor, and the heating element. For example, to access the cross-flow blower wheel, a bearing plate attached to the left end panel is first removed, and then the control panel is removed so as to expose the motor and remove set screws attaching it to the shaft of the blower wheel. Finally, the cross-flow blower wheel is removed to the side through the hole in the end panel created by removing the bearing plate. The motor is even more difficult to remove or replace because, after performing all of the above-described steps required to remove the cross-flow blower wheel, screws securing the motor to a panel intermediate the wheel and the motor are removed. The heating element is located below the cross-flow blower wheel, so the wheel also has to be removed before accessing the heater element. Then, the heating element is connected using fastening apparatus that are difficult to access.

SUMMARY OF THE INVENTION

It is an object of the invention to provide an air conditioning unit that can easily be serviced.

It is also an object to provide a package terminal air conditioner that has a modular blower and heater assembly that can readily be disengaged and removed intact thereby providing easy access to the components.

It is also an object to provide a blower and heater module that inserts down into an indoor section compartment from the top wherein the module may readily be removed for service. It is also an object to secure the rear of the module to the compartment wall using fastening apparatus that does not require manual manipulation.

It is also an object to provide a modular air conditioning unit that includes a cross-flow blower wheel, a motor, a heating element, and a scroll portion that has a closely controlled alignment with the blower wheel. Further, it is an object that the motor and the heating element be readily engageable and disengageable from controls of the air conditioner.

The foregoing and other objects and advantages are provided by a blower and heater module which, in accordance with the invention, is adapted for removal intact from an air conditioner compartment having an electrical connector. More specifically, the module comprises a housing which comprises a back scroll portion and a pair of opposing ends. A crossflow blower wheel is spaced adjacent to the scroll portion and is supported between the opposing ends, and a motor is affixed to the cross-flow blower wheel. The housing has a heating element, and an electrical connector which is adapted for removably mating to the compartment connector for supplying electrical power to the motor and the heating element. Further, means are provided for disengageably securing the housing in the air conditioner compartment wherein the module can be readily removed intact from the compartment for servicing. It is preferable that the securing means comprise at least a pair of rearwardly extending tabs adapted for insertion into supporting slots in the rear wall of the compartment. Further, it is preferable that each of the tabs have a downwardly facing notch for engaging bottom portions of the slots. Also, it is preferable that the securing means comprise a mounting bracket extending forwardly from each of the ends.

The invention may also be practiced by the method of installing intact a blower and heater module into a package terminal air conditioner having an open top compartment with a rear panel having a pair of slots and an indoor coil at the front, the compartment having an electrical connector, the module comprising a housing having a back scroll portion and a pair of ends with rearwardly extending tabs and top mounting brackets, the module further comprising a heating element affixed to the housing and a cross-flow blower wheel spaced adjacent the scroll portion and supported between the opposing ends with a motor affixed to the cross-flow blower wheel, the module having an electrical connector connected to the motor and the heating element, comprising the steps of lowering the module from above down through the open top of the compartment, inserting the tabs of the module into the slots of the partition to support the back of the module, removably affixing the mounting brackets of the module to the compartment to support the front of the module, and connecting the module connector to the connector of the compartment.

BRIEF DESCRIPTION OF THE DRAWINGS

The foregoing objects and advantages of the invention will be more fully understood by reading the Description of the Preferred Embodiment with reference to the drawings wherein.

DESCRIPTION OF THE PREFERRED EMBODIMENT

Figure 2:
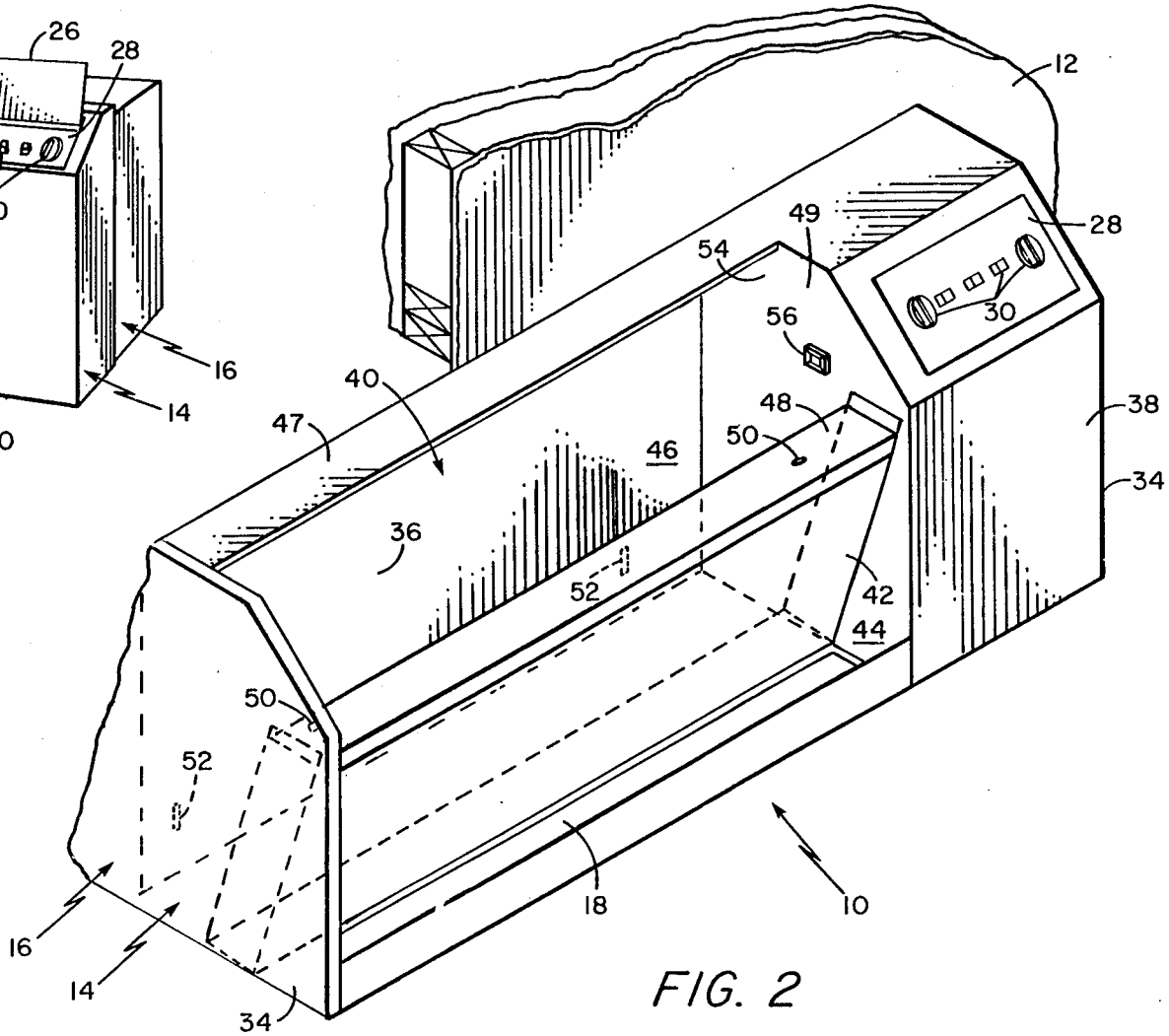
FIG. 2 is a front perspective view of the package terminal air conditioner without the front cover and with the blower and heater module removed.

Referring to the drawings wherein like reference numerals designate like parts throughout the several views, a modular blower and heater assembly 32 or module is adapted for intact removal from a compartment 46 of an air conditioner 10 for service. The module 32 generally includes a housing 58 which includes a back scroll portion 72 and a pair of ends 76*a* and *b*. A cross-flow blower wheel 60 is supported by the ends 76*a* and *b* and is held adjacently spaced from the scroll portion 72 with its motor 62 affixed to one end. The module also includes an electric heating element 64 which, along with the motor 62, is coupled through a removable connector 68 to a source of electric power. The housing 58 is mounted in the compartment 46 using readily disengagable tabs 88 and mounting brackets 80 such that module 32 can readily be removed intact as a single assembly so as to provide easy access to its component parts for service.

Figure 1:
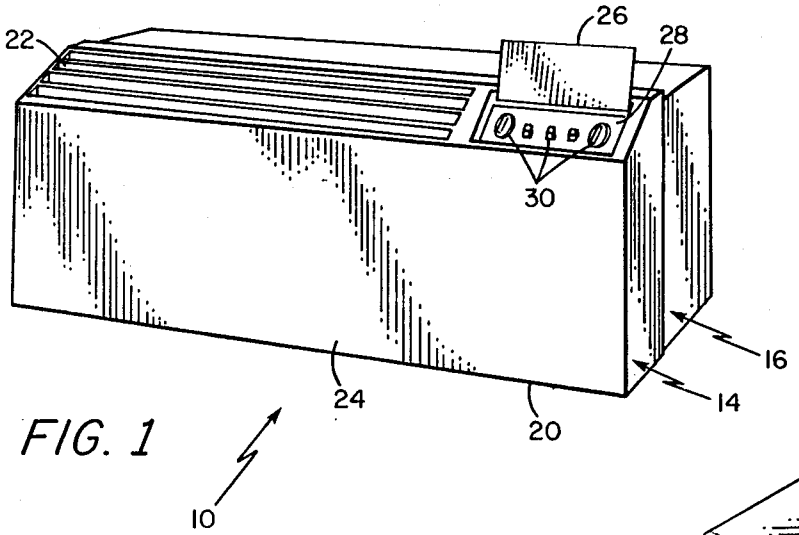
FIG. 1 is a front perspective view of a package terminal air conditioner.

Referring to FIG. 1, a package terminal air conditioner 10 is adapted for using the invention to advantage. Although other mounting arrangements are possible, package terminal air conditioner 10 is conventionally mounted in a wall 12 (FIG. 2) with an indoor section 14 communicating with room air on the inside and an outdoor section 16 communicating with fresh air on the outside. Generally, package terminal air conditioner 10 draws room air in from an aperture 18 (FIG. 2) on the underside 20 and expells it through a grille 22 after being either cooled or heated, depending on the climatic condition. In other words, air conditioner 10 alternately operates in a heating mode or a cooling mode as required. Front cover 24 encases the indoor section 14 and has a lid 26 which can be raised to expose a control panel 28 that has operator actuable control knobs 30 which are used to control the operation of air conditioner 10.

Figure 3:
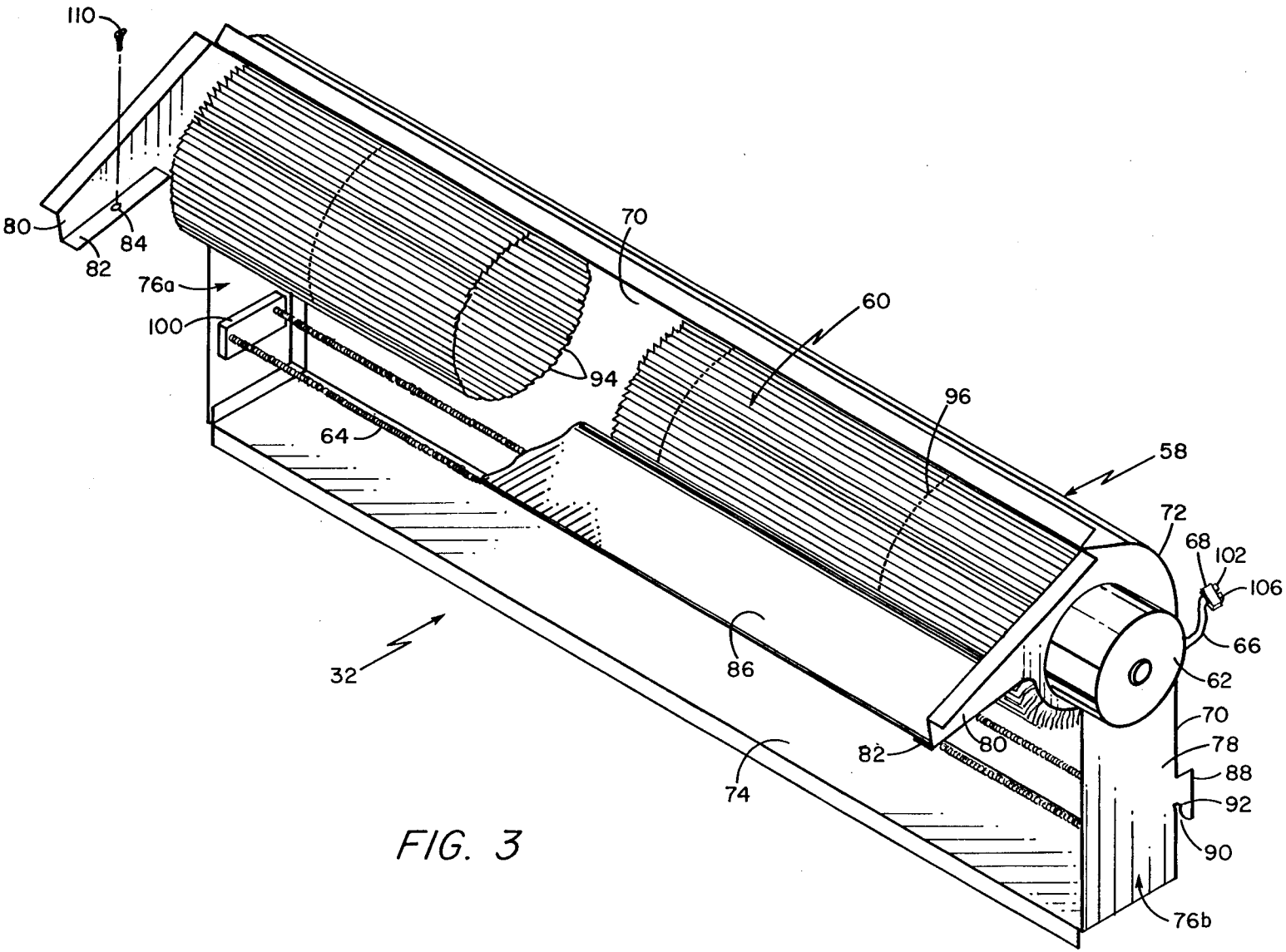
FIG. 3 is a front perspective view of the blower and heater module.

Referring to FIG. 2, the indoor section 14 of air conditioner 10 is shown without front cover 24 and with the blower and heater module 32 of FIG. 3 removed. Indoor section 14 has end panels 34 and a main partition 36 or panel that divides air conditioner 10 into the indoor section 14 and outdoor section 16. The control panel 28 is mounted in cabinet 38 which houses suitable conventional controls (not shown) for air conditioner 10. Laterally adjacent to cabinet 38 is a chamber 40 or plenum that is divided by evaporator 42 or indoor coil into an air intake chamber 44 and a compartment 46 which is adapted for receiving and mounting blower and heater module 32. Horizontal panel or slat 47 covers a small rear portion of compartment 46, but otherwise compartment 46 has an open top or mouth 49 for receiving or removing module 32. Evaporator 42 is mounted at a suitable angle as shown with air intake aperture 18 to the front. Evaporator 42 has a top casing 48 having at least two laterally spaced screw holes 50. Partition 36 has at least a pair of laterally spaced vertical slots 52 which, as will be described, are used for mounting module 32. Also, the inward wall 54 of cabinet 38 has a connector receptacle 56 or connector which will be described later herein.

In accordance with the invention, FIG. 3 shows a perspective view of blower and heater module 32 which is a modular unit that is inserted and removed intact from compartment 46. Module 32 includes a box 58 or housing, a cross-flow blower wheel 60 with motor 62, electric resistive heating element 64, and electrical interconnections (not shown) which terminate through cable 66 at electrical connector 68. Box 58 or housing includes a back 70 with an upper scroll portion 72, a bottom 74 and a pair of opposing ends 76*a* and *b* or side panels. Ends 76*a* and *b* each have an elongated vertical member 78 and a forwardly extending mounting bracket 80 having a perpendicular flange 82 or support slat with a screw hole 84. The top of each vertical member 78 bows in a suitable manner to conform with scroll portion 72 of back 70. Cut-off slat 86 extends between ends 76*a* and *b* below blower wheel 60 and provides a conventional wheel air path seal. Extending rearwardly from each end 76*a* and *b* is a mounting tab 88 having an inverted V-shaped notch 90 which terminates at a small substantially circular hole 92. As will be understood later herein, tabs 88 are laterally spaced so as to align with partition slots 52 for insertion thereinto.

As here shown, cross-flow blower wheel 60 includes a plurality of elongated curved blades 94 that are parallelly spaced and affixed in a generally annular ring by bands 96. Cross-flow blower wheel 60 extends laterally in box 58 and is suitable spaced in conventional manner from scroll portion 72 of box 58 and is so spaced from cut-off slat 86 that when wheel 60 is rotated, air is drawn up from underneath and forced outwardly towards the front and top. Cross-flow blower wheel 60 is supported by respective lateral ends 76*a* and *b* of box 58 and is mounted for rotation within box 58. For example, at one end 76*a*, cross-flow blower wheel 60 may be mounted using a suitable bearing (not shown). At the opposite end 76*b*, cross-flow blower wheel 60 is supported by shaft 98 (FIG. 5) that is connected to blower drive motor 62.

Electric resistive heating element 64 here shown as a heating coil is mounted by suitable means such as, for example, insulators 100 in the bottom portion of box 58. Although not shown here, heating element 64 is suitably connected to electrical terminals 102 within connector 68. Also, motor 62 is connected through cable 66 to terminals 106 in connector 68.

Blower and heater module 32 can be readily inserted intact or removed intact from compartment 46 of package terminal air conditioner 10. More specifically, to mount module 32 in compartment 46, module 32 is lowered down through the mouth 49 of compartment 46 such that mounting tabs 88 respectively align with slots 52. The slots 52 are longer than mounting tabs 88 such that tabs 88 are inserted into upper portions of slots 52, and then module 32 is slightly lowered so that notches 90 seat down onto and engage the bottom edges of slots 52 in an interference fit. The circular holes 92 provide relief such that the portion of partition 36 below slots 52 is squeezed by the sides of notch 90 thereby securely engaging the module 32 to the partition 36 so as to prevent vibration noise during operation. Since the rear of module 32 within compartment 46 is substantially inaccessible, tabs 88 and slots 52 provide an advantage in assembly and disassembly because manipulation of manually actuated fastening apparatus such as bolts or screws is not required. Next, the mounting brackets 80 are seated on the top casing 48 of evaporator 42 with respective screw holes 84 aligning with screw holes 50. Then, screws 110 are inserted down through respective screw holes 84 and 50 to securely anchor mounting bracket 80 to evaporator 42 of air conditioner 10. Connector 68 is then inserted into receptacle 56 which is a mating connector. To remove module 32 for service, the above assembly steps are reversed. That is, after front cover 24 is removed, connector 68 is disconnected from receptacle 56 and then screws 110 are removed. Then, without the necessity of reaching behind module 32 to remove manually manipulated fastening apparatus, module 32 is lifted slightly so as to disengage notches 90 from slots 52. Then, module 32 is moved slightly forward so that tabs 88 exit from slots 52. Then, module 32 is free to be removed through mouth 108 of compartment 46 by moving the top slightly forward to clear slat 47 and then lifting. In so removing module 32 intact from compartment 46 of air conditioner 10, heating element 64, motor 62, and cross-flow blower wheel 60 are readily and easily accessible for service.

Figure 4:
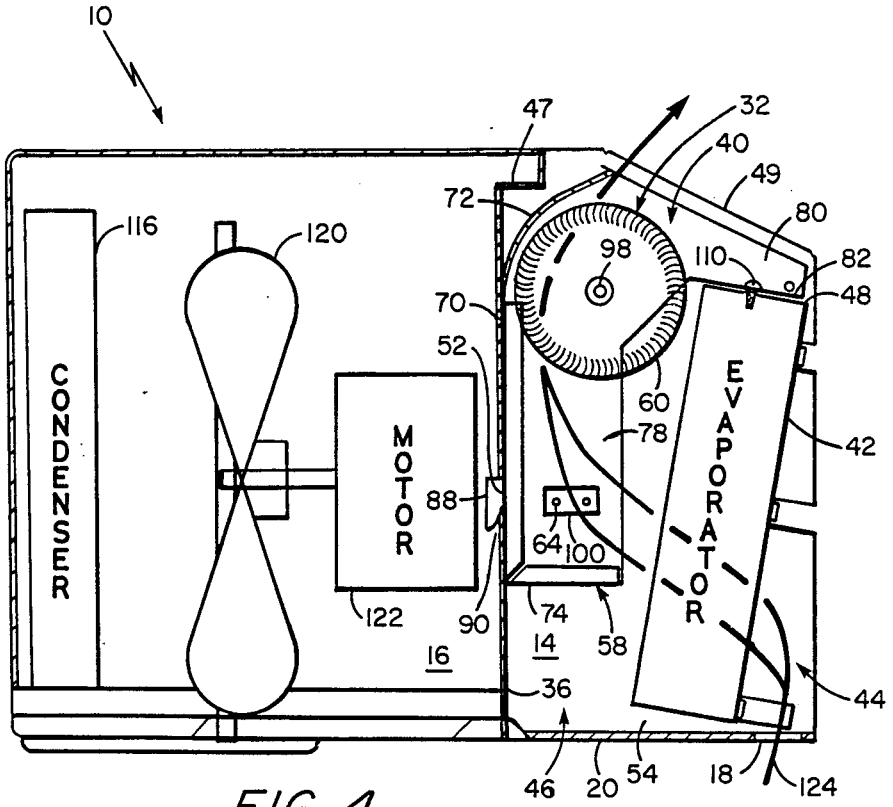
FIG. 4 is a sectioned side view of the package terminal air conditioner.
Figure 5:
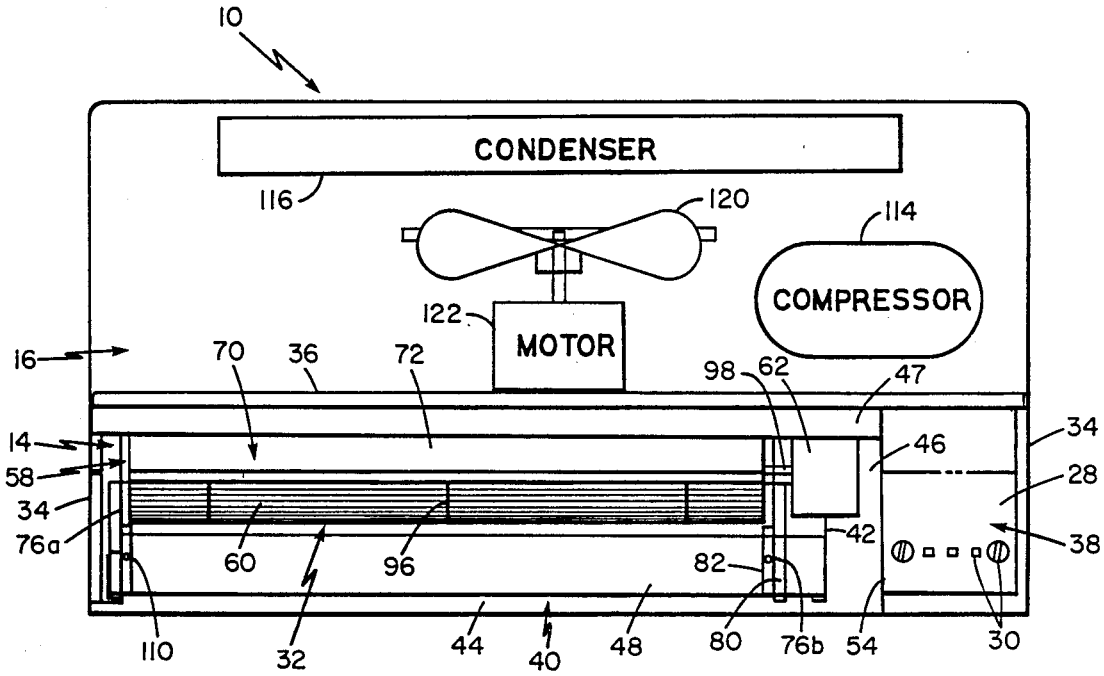
FIG. 5 is a top view of the package terminal air conditioner with the front and rear covers removed.

Referring to FIGS. 4 and 5, cross-flow blower wheel 60 is respectively shown in side sectioned and top views of package terminal air conditioner 10. As controlled by control knobs 30 on control panel 28, package terminal air conditioner 10 can be operated in either a cooling mode or a heating mode. In the cooling mode, compressor 114 is activated and, in conventional manner, refrigerant is forced through a refrigeration loop including condenser 116, an expansion valve (not shown), and evaporator 42 back to compressor 114. A propeller fan 120 which is driven by motor 122 attached to partition 36 is activated, and it blows fresh air which is circulated into outdoor section 16 from outside back through condenser 116 to remove heat. Also, motor 62 is activated by an appropriate control which energizes terminals 106 of connector 68 such that cross-flow blower wheel 60 is rotated. Specifically, cross-flow blower wheel 60 draws room air 124 from aperture 18 through inclined evaporator 42 into the lower portion of box 58 from where it is forced under pressure by wheel 60 back into the room through grille 22. As is well known, the air gives up heat to support evaporation within evaporator 42 thus cooling the air.

Alternately, in the heating mode, heating element 64 is energized instead of compressor 114. That is, in response to an operator actuable input through control knobs 30, suitable controls within control cabinet 38 energize terminals 106 of connector 68 to activate motor 62, and also electrical resistive heating element 64 is energized. Accordingly, room air 124 is drawn by blower wheel 60 in through aperture 18 through deactivated evaporator 42 into box 58 where it is heated by heating element 64 before being expelled back into the room through grille 22.

In accordance with the invention, package terminal air conditioner 10 uses a cross-flow blower wheel 60 that produces very low air rush noise thereby providing relatively quiet operation. At the same time, the cross-flow blower wheel 60 is part of a modular unit 32 that can be removed intact for quick and easy service. Specifically, the module 32 or modular unit also includes a housing 58 with ends 76*a* and *b* that support the blower wheel 60 and a back 70 with a scroll portion 72 that is closely spaced to the blower wheel 60. Since the blower wheel 60 and the housing 58 are mounted as a unit, proper clearance between the two is maintained to a close tolerance. The module 32 also includes the motor 62 for the blower wheel and electric heating element 64 which is used in the heating mode of operation. Accordingly, all of the parts of the modular unit 32 can easily and readily be removed, serviced, and then replaced intact as a modular unit.

This concludes the Description of the Preferred Embodiment. However, a reading of it by those skilled in the art will bring to mind many modifications and alterations which do not depart from the spirit and scope of the invention. Accordingly, it is intended that the scope of the invention be limited only by the appended claims.

What is claimed is:

1. A blower and heater module adapted for removal intact from an air conditioner compartment having an electrical connector, said module comprising:

a housing comprising a back scroll portion and a pair of opposing ends;

a cross-flow blower wheel spaced adjacent said scroll portion and supported between said opposing ends;

a motor affixed to said cross-flow blower wheel;

a heating element connected to said housing;

an electrical connector adapted for removably mating with said compartment connector for supplying electrical power to said motor and said heating element; and means for disengageably securing said housing in said air conditioner compartment wherein said module can readily be removed intact up through an open top of said compartment for servicing.

2. The module recited in claim 1 wherein said securing means comprises at least a pair of rearwardly extending tabs adapted for insertion into supporting slots in a rear wall of said compartment.

3. The module recited in claim 2 wherein said tabs each have a downwardly facing notch.

4. The module recited in claim 1 wherein said securing means comprises a mounting bracket extending forwardly from each of said ends.

5. In a package terminal air conditioner having a lateral partition which divides the interior of the air conditioner into an indoor section and an outdoor section, and the indoor section includes an open top compartment having the partition at the rear and an indoor coil at the front, the compartment having an electrical connector interconnected with controls and at least a pair of mounting slots in the partition, a blower and heater module adapted for intact removal and insertion into the compartment, the module comprising: p1 a housing comprising a back scroll portion and a pair of ends each having a rearwardly directed tab spaced for insertion into the respective mounting slots of the partition, each of the ends further having a forwardly directed support bracket adapted for seating on the indoor coil;

a cross-flow blower wheel spaced adjacent the scroll portion and supported between the opposing ends;

a heating element connected to the housing;

an electrical connector adapted for removably mating with the electrical connector in the compartment and interconnecting the motor and heating element to respective sources of electrical power; and means for removably securing the module in the compartment wherein, in one mode of operation when the blower and heating element are activated, room air is drawn through the indoor coil and expelled by the cross-flow blower wheel back into the room after being heated by the heating element and, in an alternate mode of operation when the blower and the indoor coil are activated, the blower draws air through the indoor coil where it is cooled before being expelled by the crossflow blower wheel back into the room.

6. In a package terminal air conditioner having a lateral partition which divides the interior of the air conditioner into an indoor section and an outdoor section with the indoor section including an open top compartment bounded by the partition at the rear and the partition has at least a pair of laterally spaced slots, a blower and heater module adapted for intact removal from and insertion into the compartment, the module comprising:

a housing comprising a back scroll portion and a pair of opposing ends;

a cross-flow blower wheel spaced adjacent the scroll portion and supported between the opposing ends;

a motor affixed to the cross-flow blower wheel and removably connected to the housing;

a heating element connected to the housing;

an electrical connector adapted for disengageably electrically connecting the motor and the heating element to the air conditioner; and the housing having at least a pair of tabs spaced for insertion into the slots of the partition to support the rear of the module and at least a pair of forwardly extending mounting brackets for supporting the front of the module, the mounting brackets and the tabs being readily disengageable so that the module can be removed intact from the air conditioner for servicing.

7. A package terminal air conditioner comprising:

a partition dividing the air conditioner into an indoor section and an outdoor section;

a compressor, condenser, and condenser fan positioned in the outdoor section;

a control cabinet positioned in the indoor section;

an evaporator positioned in the indoor section;

an open top compartment positioned in the indoor section between the evaporator and the partition;

a blower and heater module removably positioned in the compartment, the module comprising a housing with a back scroll portion and a pair of opposing ends, a cross-flow blower wheel supported by the ends and being held in close alignment adjacent the scroll portion, a motor connected to the cross-flow blower wheel and one of the ends, an electrical resistive heating element attached to the housing, the housing further comprising means for disengageably securing the module within the compartment wherein the module can readily be removed intact up through the open top of the compartment for servicing of the blower wheel, motor, or heating element.

8. The air conditioner recited in claim 7 wherein said partition has at least a pair of slots and said securing means of said housing comprises a pair of rearwardly extending tabs spaced for insertion into said slots.

9. The method of installing intact a blower and heater module into a package terminal air conditioner having an open top compartment with a rear panel having a pair of slots and an indoor coil at the front, the compartment having an electrical connector, the module comprising a housing having a back scroll portion and a pair of ends with rearwardly extending tabs and top mounting brackets, the module further comprising a heating element affixed to the housing and a cross-flow blower wheel spaced adjacent the scroll portion and supported between the opposing ends with a motor affixed to the cross-flow blower wheel, the module having an electrical connector connected to the motor and the heating element, comprising the steps of:

lowering the module from above down through the open top of the compartment;

inserting the tabs of the module into the slots of the partition to support the back of the module;

removably affixing the mounting brackets of the module to the compartment to support the front of the module; and connecting the module connector to the connector of the compartment.

* * * * *